US006573809B1

(12) United States Patent
Wakayama et al.

(10) Patent No.: US 6,573,809 B1
(45) Date of Patent: Jun. 3, 2003

(54) DIELECTRIC RESONATOR DEVICE, DIELECTRIC DUPLEXER, AND COMMUNICATION APPARATUS INCORPORATING SAME

(75) Inventors: Tsutomu Wakayama, Ishikawa-ken; Takashi Maruyama, Kanazawa, both of (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 09/661,213

(22) Filed: Sep. 14, 2000

(30) Foreign Application Priority Data

Sep. 14, 1999 (JP) ..... 11-260013

(51) Int. Cl.[7] ..... H01P 5/12
(52) U.S. Cl. ..... 333/134; 333/206
(58) Field of Search ..... 333/206, 134, 333/202, 202 DB, 222

(56) References Cited

U.S. PATENT DOCUMENTS 4,567,454 A * 1/1986 Saito ..... 333/206
4,795,992 A * 1/1989 Saito et al. ..... 333/206
5,278,527 A * 1/1994 Kenoun et al. ..... 333/202
5,412,359 A * 5/1995 Kazama et al. ..... 333/206
6,057,746 A * 5/2000 Ito ..... 333/134

FOREIGN PATENT DOCUMENTS

| | | | |
|---|---|---|---|
| JP | 402050502 A | * | 2/1990 |
| JP | 7-142906 | | 6/1995 |
| JP | 7235805 | | 9/1995 |
| JP | 7-240604 | | 9/1995 |
| JP | 10-079605 | | 3/1998 |
| JP | 11-205009 | | 7/1999 |

OTHER PUBLICATIONS

European Search Report dated Aug. 2, 2002.

* cited by examiner

*Primary Examiner*—Robert Pascal
*Assistant Examiner*—Joseph Chang
(74) *Attorney, Agent, or Firm*—Dickstein, Shaprio, Morin & Oshinsky LLP

(57) ABSTRACT

A compact dielectric resonator device that permits reduction in size of a metal cover without deterioration of the filter characteristics of the device. In this dielectric resonator device, a plurality of dielectric coaxial resonators are mounted on a substrate. A metal cover is arranged in such a manner as to enclose substantially only the open faces of the dielectric coaxial resonators, where terminals electrically connected to inner conductors of the dielectric coaxial resonators are led out. In addition, protrusions of the metal cover are electrically connected to parts of the outer conductors of the dielectric resonators between the adjacent dielectric coaxial resonators.

10 Claims, 5 Drawing Sheets

DIELECTRIC RESONATOR DEVICE, DIELECTRIC DUPLEXER, AND COMMUNICATION APPARATUS INCORPORATING SAME

BACKGROUND OF THE INVENTION

1. Field of the Invention

The present invention relates to dielectric resonator devices, dielectric duplexers, and communication apparatus incorporating the same, which are used in mobile communication equipment such as cellular phones.

2. Description of the Related Art

Conventionally, as shown in FIG. 13, a dielectric filter formed by coupling a plurality of individual dielectric coaxial resonators has the following structure. A plurality of dielectric coaxial resonators 1*a* to 1*h* are mounted on the upper surface of a substrate 2, and a metal cover 3 is attached to the substrate 2 to cover the substrate and the plurality of dielectric coaxial resonators 1*a* to 1*h*. The metal cover 3 is electrically connected to grounding electrodes 4 on the substrate 2. In this figure, the metal cover 3 is shown in phantom.

However, in order to miniaturize the mobile communication equipment, by making the dielectric filter having the above structure smaller, it is necessary to reduce the dimensions of the metal cover. A device which can solve the problem, as shown in Japanese Unexamined Patent Application Publication No. 7-235805, is a resonator device in which the upper surfaces of dielectric coaxial resonators are exposed while the coupling parts thereof are covered by a metal cover.

Nevertheless, the structure in which substantially only the coupling parts of the dielectric coaxial resonators are covered by the metal cover causes a problem. There are some parts in which the paths of ground currents flowing from outer conductors of the dielectric coaxial resonators to the grounding electrodes on the substrate tend to be long. Therefore, unless the metal cover is electrically connected very securely to the outer conductors of the dielectric coaxial resonators, the filter characteristics of the device can be deteriorated.

SUMMARY OF THE INVENTION

The present invention is able to address these problems by providing a dielectric resonator device, a dielectric duplexer, and a communication apparatus incorporating the same, which can be miniaturized while preventing the deterioration of filter characteristics caused by the reduction in the size of the metal cover.

According to a first aspect of the present invention, there is provided a dielectric resonator device including a plurality of dielectric coaxial resonators having outer conductors and inner conductors, a substrate having the plurality of dielectric coaxial resonators disposed thereon, and a metal cover connected to grounding electrodes on the substrate. In this dielectric resonator device, one dielectric coaxial resonator of the plurality of dielectric coaxial resonators is separated from the adjacent dielectric coaxial resonator by a gap, and a protruding part of the metal cover electrically connects the outer conductors of the adjacent dielectric coaxial resonators to each other in the gap.

With this arrangement, it is not necessary for the metal member to cover the upper surfaces of the plurality of dielectric coaxial resonators. Further, the protruding part provides a short path via the metal cover, for conducting ground currents from one or both of the side surfaces of the pair of adjacent dielectric coaxial resonators, to the closest one of the grounding electrodes on the substrate.

In addition, the metal member may substantially enclose (sufficiently to avoid substantial electromagnetic radiation) at least one of an area close to open-circuited faces of the dielectric coaxial resonators and an area where terminals electrically connected to the inner conductors of the dielectric coaxial resonators are led out.

The protruding part of the metal member may be bonded to the outer conductors of the dielectric coaxial resonators by a conductive bonding agent in the gap.

According to a further aspect of the invention, the protruding part of the metal member may be made of an elastic material.

Furthermore, the metal cover may be formed of sheet metal, and the protruding part of the metal cover may be partially bent. With this arrangement, the protruding part of the metal cover may be made more rigid, and also, the surface area of the regions where the protruding part of the metal cover is bonded to the outer conductors of the dielectric coaxial resonators may be increased.

Furthermore, the protruding part of the metal cover may be ribbed. This increases the rigidity of the protruding part of the metal cover and can also improve bonding reliability. Or, alternatively, a bonding hole may be punched in the protruding part of the metal cover. With this arrangement, as in the case of ribbing, bonding reliability can be improved.

According to a second aspect of the invention, there is provided a dielectric duplexer including the dielectric resonator device described above, a transmission filter and a reception filter each being formed by a respective dielectric resonator device. In this dielectric duplexer, the dielectric coaxial resonators of the transmission filter are separated from the adjacent dielectric coaxial resonators of the reception filter by a gap.

According to a third aspect of the present invention, there is provided a communication apparatus including one of the dielectric resonator device and the dielectric duplexer described above.

Other features and advantages of the present invention will become apparent from the following description of embodiments of the invention which refers to the accompanying drawings.

DESCRIPTION OF EMBODIMENTS OF THE INVENTION

Figure 1:
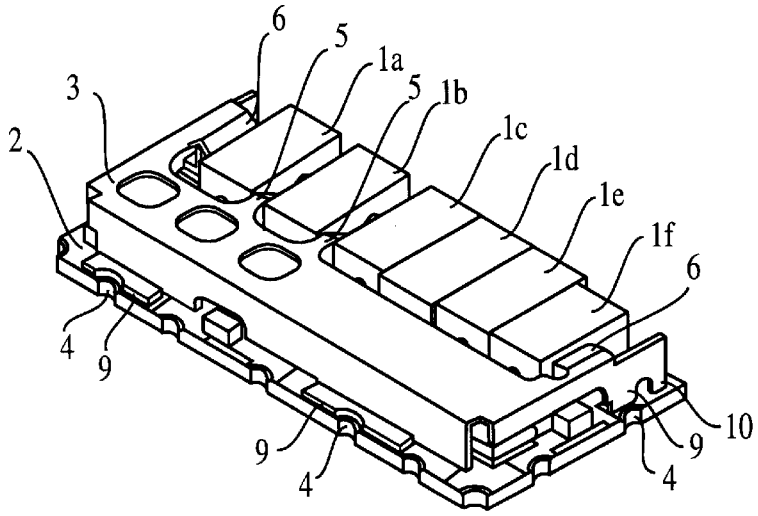
FIG. 1 is a perspective view of the appearance showing the structure of a dielectric duplexer according to a first embodiment of the present invention.
Figure 2:
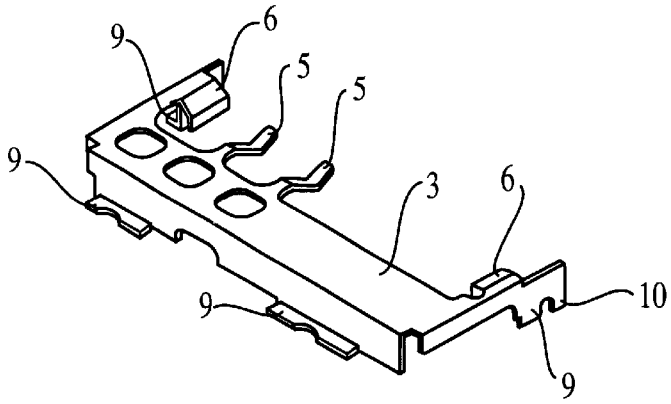
FIG. 2 is a perspective view of the appearance of a metal cover used in the above dielectric duplexer.
Figure 3:
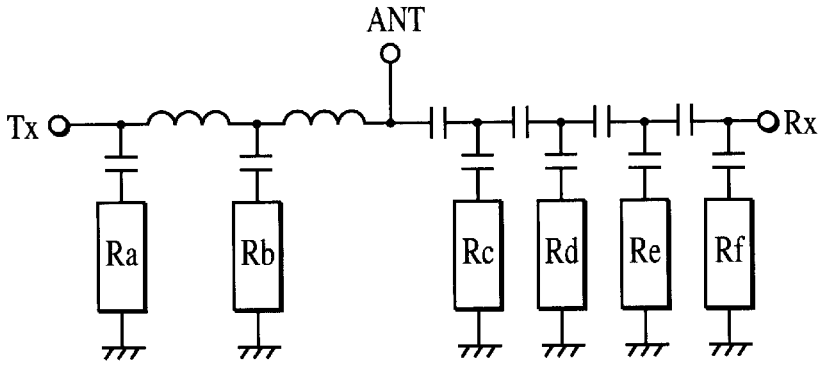
FIG. 3 is a circuit diagram of the above dielectric duplexer.

Referring to FIGS. 1 to 3, a description will be given of the structure of a dielectric duplexer according to a first embodiment of the present invention.

FIG. 1 is a perspective view of a dielectric duplexer. FIG. 2 is a perspective view of only a metal cover used in the above dielectric duplexer. In FIG. 1, reference numerals 1*a*, 1*b*, 1*c*, 1*d*, 1*e*, and 1*f* denote dielectric coaxial resonators having outer conductors formed on the outer surfaces of rectangular-parallelepiped dielectric members. Through-holes are formed in the central axes of the dielectric members, and inner conductors are formed on the inner surfaces of the through-holes. At the right-hand end faces of the dielectric coaxial resonators, as shown in FIG. 1, the inner conductors are short-circuited to the outer conductors, and at the left-hand end faces thereof, no outer conductors are formed, whereby the inner conductors are open-circuited. Those skilled in the art will be aware of alternative resonator structures that can be used.

Pin terminals (not shown) may be electrically connected to the inner conductors by being inserted into the through-holes of the dielectric coaxial resonators 1*a* to 1*f*. Other known types of terminals may be used as well, for example capacitive terminals.

The outer conductors of the dielectric coaxial resonators 1*a* to 1*f* are bonded to grounding electrodes 4 disposed on the upper surfaces of a substrate 2 by using a conductive bonding agent such as solder. Side surfaces of the resonators are separated by a specified gap, e.g. 0.1 mm–5 mm. Reference numeral 3 denotes a metal cover. As also shown in FIG. 2, the metal cover 3 is formed by stamping and bending a metal plate. The metal cover 3 has protrusions 5 protruding in the axial direction of the dielectric coaxial resonators and conductive side portions 6 for being electrically connected to side surfaces of the outermost dielectric coaxial resonators in a state in which the metal cover 3 is bonded to the substrate 2. In addition, at a plurality of spots on the metal cover 3 are formed grounding terminals 9 for being connected to the grounding electrodes 4 on the substrate 2, and projections 10 for determining a position of the metal cover 3 with respect to the substrate 2.

In the state shown in FIG. 1, the grounding terminals 9 of the metal cover 3 are soldered to the grounding electrodes 4 on the substrate 2. In addition, the protrusions 5 of the metal cover 3 are interposed between the dielectric coaxial resonators 1*a* and 1*b* and between the dielectric coaxial resonators 1*b* and 1*c*, and the outer conductors of the mutually adjacent dielectric coaxial resonators 1*a*, 1*b*, and 1*c* are bonded to each other via the protrusions 5, by using a conductive bonding agent such as solder. Since the protrusions 5 of the metal cover 3 are bent in a plane perpendicular to the substrate 2, the rigidity of the protrusions 5 is increased, particularly against applied forces in a direction parallel to the substrate 2. As a result, even when the protrusions 5 are narrow, the deformation of the protrusions 5 can be prevented. Thus, the protrusions 5 can be reliably connected to the outer conductors of the dielectric coaxial resonators.

In addition, as shown in FIG. 2, in the metal cover 3, since the grounding terminals 9 are disposed near the protrusions 5 and the conductive side portions 6, short paths can be provided for ground currents to flow from the outer conductors of the dielectric coaxial resonators to the nearby grounding electrodes on the substrate.

The positioning projections 10 disposed on the metal cover 3 are inserted in holes in the substrate 2 to set the position of the metal cover 3 with respect to the substrate 2. Furthermore, when the dielectric coaxial resonators 1*a* to 1*f* and the metal cover 3 are disposed on the substrate 2, the dielectric coaxial resonators 1*a* to If are positioned by the protrusions 5 and the conductive side portions 6 of the metal cover 3. Thus, the positional relationships between the substrate 2, the metal cover 3, and the dielectric coaxial resonators 1*a* to 1*f* can be easily fixed, particularly for securing the resonators to the metal cover by soldering. As a result, in mass production of the dielectric resonator devices, stable filter characteristics can be obtained.

Alternatively, by making the metal cover 3 of an elastic material, and by arranging the protrusions 5 and the conductive side portions 6 to abut with the outer conductors of the corresponding dielectric coaxial resonators, the outer conductors of the dielectric coaxial resonators can be electrically connected to the metal cover without soldering.

FIG. 3 shows the circuit diagram of the dielectric duplexer. Reference numerals Ra to Rf denote resonators corresponding to the dielectric coaxial resonators 1*a* to 1*f* shown in FIG. 1. The resonators Ra and Rb are disposed between a transmitted-signal input port Tx and an antenna port ANT via capacitors and inductors having specified electrical lengths, for example $\lambda/4$ or $\lambda/2$. The resonators Rc to Rf, which are connected in sequence via capacitors, are disposed between the antenna port ANT and a received-signal output port Rx.

The above arrangement forms a transmission filter constituted of the two resonators Ra and Rb, which has band-blocking-type filter characteristics, and a reception filter constituted of the four resonators Rc to Rf, which has band-pass-type filter characteristics.

In this way, although the dielectric coaxial resonators 1*a* and 1*b* of the transmission filter handle a relatively large amount of electric power, a reliable ground connection is formed by the protrusions 5 and the conductive side portions 6 of the metal cover 3, so that deterioration of the attenuation characteristics caused by detouring of the ground-current path can be prevented. In addition, one of the protrusions 5 of the metal cover 3 is electrically connected between the last-stage resonator 1*b* of the transmission filter and the first-stage dielectric coaxial resonator 1*c* of the reception filter. With this arrangement, entry of a transmitted signal into the reception filter caused by detouring of the ground current can also be prevented without fail.

Next, referring to FIGS. 4 to 6, a description will be given of the structure of a dielectric filter according to a second embodiment of the present invention.

Figure 4:
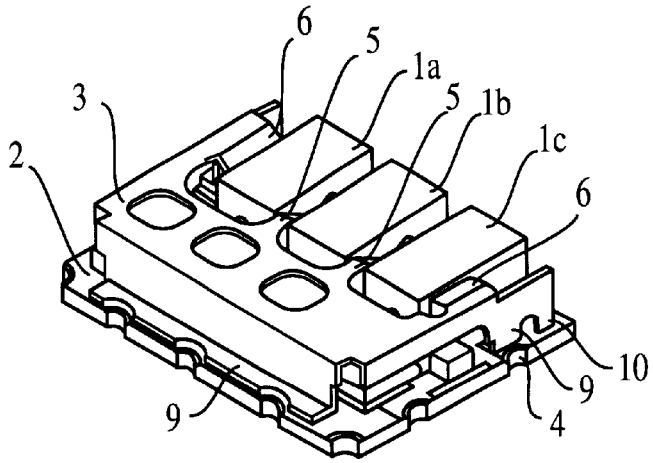
FIG. 4 is a perspective view of the appearance showing the structure of a dielectric filter according to a second embodiment of the present invention.
Figure 5:
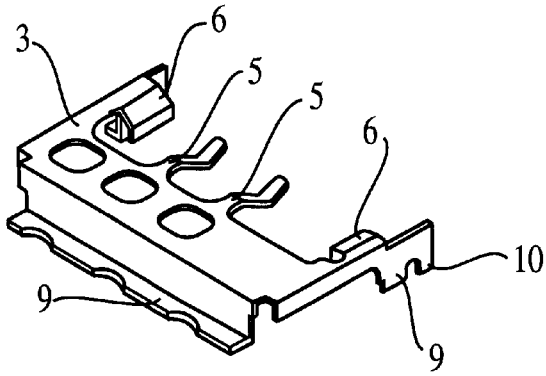
FIG. 5 is a perspective view of the appearance of a metal cover used in the above dielectric filter.

FIG. 4 is a perspective view of the dielectric filter, and FIG. 5 is a perspective view of only a metal cover of the dielectric filter. In FIG. 4, reference numerals 1*a*, 1*b*, and 1*c* denote the same dielectric coaxial resonators as those used in the first embodiment. Outer conductors of the dielectric coaxial resonators 1*a* to 1*c* are bonded to grounding electrodes on the upper surface of a substrate 2 by using a conductive bonding agent. Reference numeral 3 denotes a metal cover. As also shown in FIG. 5, the metal cover 3 is formed by stamping and bending a metal plate. The metal cover is bonded to the substrate 2. The metal cover 3 has protrusions 5 protruding in the axial direction of the dielectric coaxial resonators and has conductive side portions 6 electrically connected to the side surfaces of the outermost dielectric coaxial resonators of the aligned dielectric coaxial resonators. In addition, at a plurality of places on the metal cover 3 are formed grounding terminals 9 for being connected to the grounding electrodes on the substrate 2 and projections 10 for setting the position of the metal cover 3 with respect to the substrate 2.

As shown in FIG. 4, the grounding terminals 9 of the metal cover 3 are soldered to the grounding electrodes 4 on the substrate 2. The protrusions 5 of the metal cover 3 are interposed between the dielectric coaxial resonators 1*a* and 1*b* and between the dielectric coaxial resonators 1*b* and 1*c*, and the outer conductors of the mutually adjacent dielectric coaxial resonators 1*a*, 1*b*, and 1*c* are bonded to each other via the protrusions 5 by a conductive bonding agent such as solder. As shown in FIG. 5, on the metal cover 3, since the grounding terminals 9 are disposed near the protrusions 5 and the conductive side portions 6, the paths of ground currents flowing from the outer conductors of the dielectric coaxial resonators 1*a*, 1*b*, and 1*c* to the grounding electrodes 4 on the substrate 2 can be shortened. The other effects and advantages in the second embodiment are the same as those obtained in the first embodiment.

Figure 6:
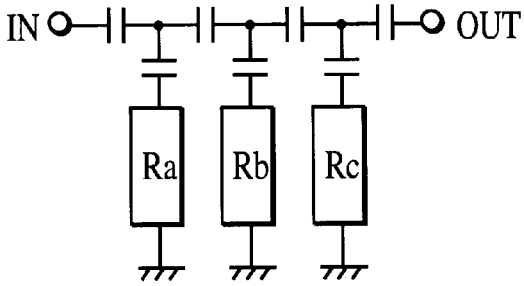
FIG. 6 is a circuit diagram of the above dielectric filter.

FIG. 6 shows a circuit diagram of the above dielectric filter. Reference numerals Ra to Rc denote resonators corresponding to the dielectric coaxial resonators 1*a* and 1*c* shown in FIG. 4. The resonators Ra to Rc, which are connected in sequence via capacitors, are disposed between an input port IN and an output port OUT.

The above arrangement forms a dielectric filter constituted of the resonators Ra to Rc of three stages, which has band-pass-type filter characteristics.

Next, referring to FIGS. 7 and 8, a description will be given of the structure of a dielectric duplexer according to a third embodiment of the present invention.

Figure 7:
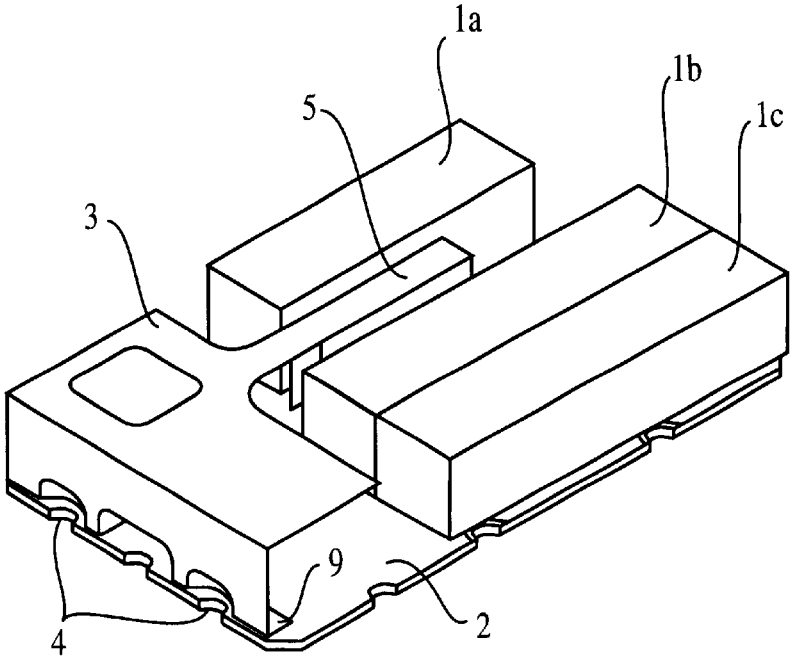
FIG. 7 is a perspective view of the appearance showing the structure of a dielectric duplexer according to a third embodiment of the present invention.
Figure 8:
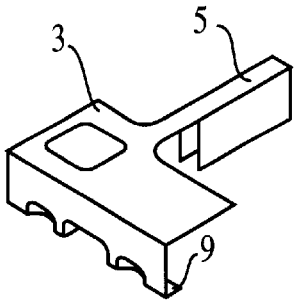
FIG. 8 is a perspective view of the appearance of a metal cover used in the dielectric duplexer.

FIG. 7 is a perspective view of the dielectric filter, and FIG. 8 is a perspective view of only a metal cover of the dielectric filter. In FIG. 7, reference numerals 1*a*, 1*b*, and 1*c* denote the same dielectric coaxial resonators as those used in the first embodiment. Outer conductors of the dielectric coaxial resonators 1*a* to 1*c* are bonded to grounding electrodes 4 on the upper surface of a substrate 2 by using a conductive bonding agent such as solder. Reference numeral 3 denotes a metal cover. As also shown in FIG. 8, the metal cover is formed by stamping and bending a metal plate. The metal cover 3 is bonded to the substrate 2. The metal cover 3 has protrusions 5 protruding in the axial direction of the dielectric coaxial resonators and has grounding terminals 9 connected to the grounding electrodes 4 of the substrate 2.

In the state shown in FIG. 7, the grounding terminals 9 of the metal cover 3 are soldered to the grounding electrodes 4 on the substrate 2. The protrusions 5 of the metal cover 3 are interposed between the dielectric coaxial resonators 1*a* and 1*b*, and the outer conductors of the mutually adjacent dielectric coaxial resonators 1*a* and 1*b* are bonded to each other via the protrusions 5 by a conductive bonding agent such as solder. With this arrangement, the paths of ground currents flowing from the outer conductors of the dielectric coaxial resonators to the grounding electrodes 4 on the substrate can be shortened.

In FIG. 7, the dielectric coaxial resonator 1*a* serves as a trap resonator which provides a transmission filter. The dielectric coaxial resonators 1*b* and 1*c* serve as a two-stage reception filter.

As shown in FIG. 8, the protrusion 5 of the metal cover 3 is subjected to bending and has two surfaces parallel to the mutually opposing outer surfaces of the dielectric coaxial resonators 1*a* and 1*b*. In this way, by bending the protrusion 5 of the metal cover 3, rigidity of the protrusion 5 is increased and the potential deformation thereof is thereby reduced. As a result, positional accuracy between the metal cover 3 and the plurality of dielectric coaxial resonators can be improved. Moreover, the surface area of the bond between the protrusion 5 and the outer conductors of the dielectric coaxial resonators can be increased, providing a more reliable ground connection.

Next, referring to FIGS. 9 to 12, a description will be given of examples of protrusions of the metal cover having different configurations.

Figure 9:
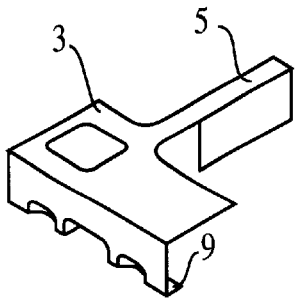
FIG. 9 is a perspective view of the appearance of a metal cover having another structure.

In an example shown in FIG. 9, a protrusion 5 of a metal cover 3 is subjected to bending. Unlike the example shown in FIG. 8, only one side of the protrusion 5 is subjected to bending. Thus, the protrusion 5 has a surface along the outer surface of one of the adjacent two dielectric coaxial resonators. With this configuration, rigidity of the protrusion 5 can be improved, and also bending, soldering, and grounding can be facilitated.

Figure 10:
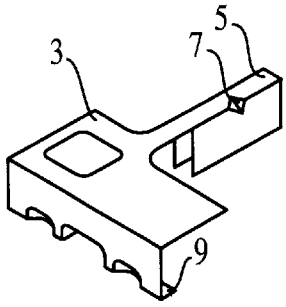
FIG. 10 is a perspective view of the appearance of a metal cover having another structure.

In an example shown in FIG. 10, a protrusion 5 of a metal cover 3 is subjected to bending, and a rib 7 is formed in the protrusion 5. With this configuration, rigidity of the protrusion 5 can be even more increased. In addition, since the rib 7 serves as a groove for guiding the flow of solder between the metal cover 3 and side surfaces of the dielectric coaxial resonators, bonding when soldered can also be enhanced.

Figure 11:
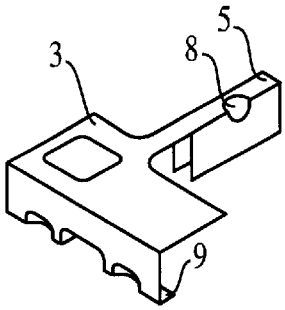
FIG. 11 is a perspective view of the appearance of a metal cover having another structure.

In an example shown in FIG. 11, a bonding hole 8 is punched in a protrusion 5 of a metal cover 3, and the protrusion 5 is subjected to bending. In this way, when the punched hole 8 is formed, the punched hole 8 serves as a groove for guiding the flow of solder between the metal cover 3 and the side surfaces of the dielectric coaxial resonators. Thus, soldering strength can be increased as in the example of FIG. 10.

Figure 12:
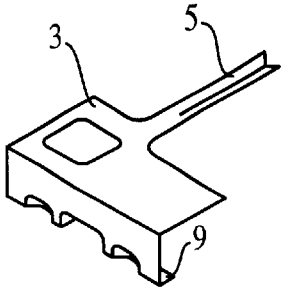
FIG. 12 is a perspective view of the appearance of a metal cover having another structure.
Figure 13:
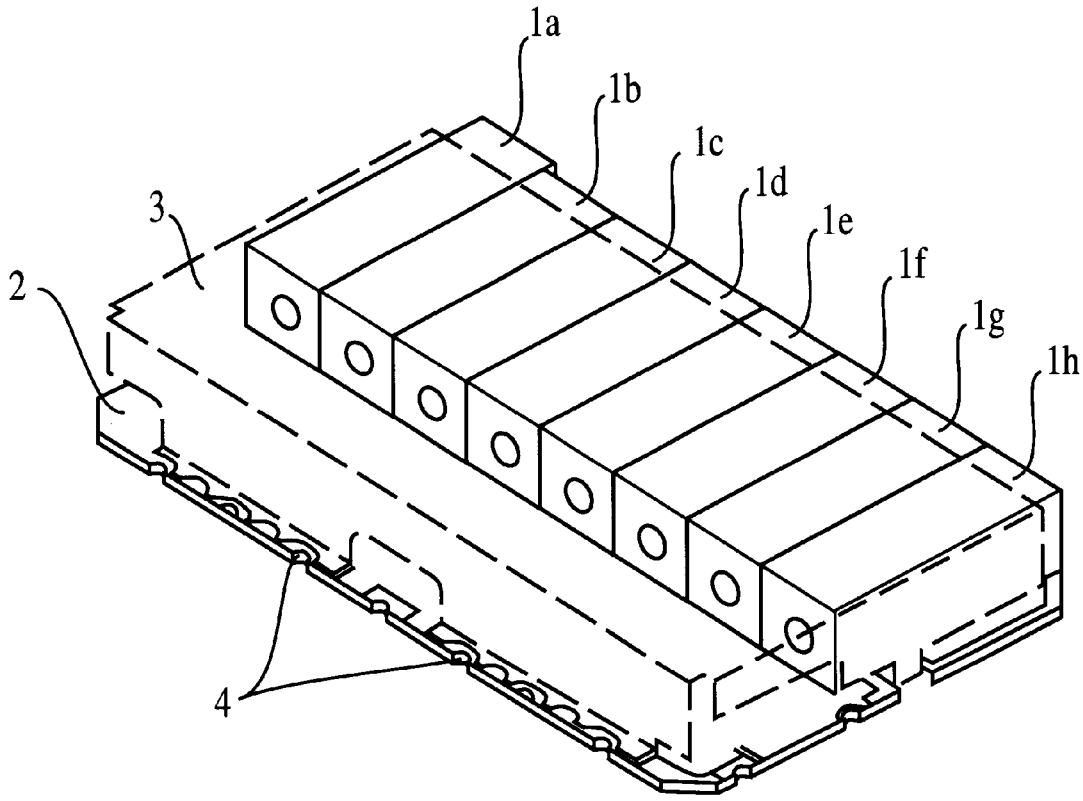
FIG. 13 PRIOR ART
FIG. 13 is a perspective view showing the structure of a conventional dielectric duplexer.

In an example shown in FIG. 12, a protrusion 5 of a metal cover 3 is subjected to bending. However, it is not bent along the outer surfaces of the dielectric coaxial resonators. Instead, the protrusion 5 is bent into a V-shape (as shown) or an inverted V-shape (not shown). In this arrangement, the amount of sheet metal used can be reduced while still improving rigidity of the protrusion. Thus, the forming process of the protrusion 5 can be facilitated.

As described above, in the dielectric resonator device of the present invention, the path of a ground current from the side surfaces of the dielectric coaxial resonators to the grounding electrodes on the substrate via the metal cover can be shortened. Thus, deterioration of filter characteristics associated with the miniaturization of the metal cover can be prevented.

In addition, according to an aspect of the invention, rigidity of the protrusion of the metal cover can be increased, and the surface area of the region where the protrusion of the metal cover is bonded to the outer conductors of the dielectric coaxial resonators can be expanded. As a result, a more reliable ground connection can be implemented.

According to another aspect of the invention, rigidity of the protrusion of the metal cover and conductivity between the protrusion of the metal cover and the outer conductors of the adjacent two dielectric coaxial resonators can be provided. Moreover, forming of the protrusion can be facilitated.

According to another aspect of the invention, even when the protrusion is made narrower, the strength of the protrusion can be maintained. Moreover, a rib can serve as a groove for guiding the in-flow of the conductive bonding agent such as solder, whereby bonding strength and conductivity can be enhanced.

According to another aspect of the invention, a punched hole can serve as a groove for guiding the in-flow of the conductive bonding agent such as solder, whereby bonding strength and conductivity can be enhanced.

According to another aspect of the invention, the ground connection of the last-stage resonator of the transmission filter and the first-stage resonator of the reception filter can be made more reliable. Therefore, entry of a transmitted signal into the reception filter and entry of a received signal into the transmission filter can be reliably prevented. As a result, reliable characteristics as a duplexer can be obtained.

Furthermore, according to another aspect of the invention, a compact communication apparatus can be obtained with the invention, having reliable communication performance capabilities.

While the present invention has been particularly shown and described with reference to embodiments thereof, it will be understood by those skilled in the art that the foregoing and other changes in form and details can be made therein without departing from the spirit and scope of the invention.

What is claimed is:

1. A dielectric resonator device comprising:

a plurality of dielectric coaxial resonators having upper and lower surfaces, and outer conductors and inner conductors;

a substrate having the lower surfaces of the plurality of dielectric coaxial resonators disposed thereon; and a metal cover connected to grounding electrodes on the substrate;

wherein a pair of dielectric coaxial resonators of the plurality of dielectric coaxial resonators are separated from each other by a gap;

wherein a protrusion extends from the metal cover into the gap and thereby contacts and electrically connects the outer conductors of the dielectric coaxial resonators to each other in the gap; and wherein the metal cover is formed by a metal plate, and a bonding hole is punched in the protrusion of the metal cover.

2. A dielectric resonator device comprising:

a plurality of dielectric coaxial resonators having upper and lower surfaces, and outer conductors and inner conductors;

a substrate having the lower surfaces of the plurality of dielectric coaxial resonators disposed thereon; and a metal cover connected to grounding electrodes on the substrate;

wherein a pair of dielectric coaxial resonators of the plurality of dielectric coaxial resonators are separated from each other by a gap;

wherein a protrusion extends from the metal cover into the gap and thereby contacts and electrically connects the outer conductors of the dielectric coaxial resonators to each other in the gap; and wherein the metal cover is formed by a metal plate, and at least one hole is punched in the protrusion of the metal cover.

3. A dielectric resonator device according to claim 1 or claim 2, wherein the metal cover substantially encloses at least one of an area close to open-circuited faces of the dielectric coaxial resonators and an area where terminals are electrically connected to the inner conductors of the dielectric coaxial resonators.

4. A dielectric resonator device according to claim 1 or claim 2, wherein the protrusion of the metal cover is bonded to the outer conductors of the dielectric coaxial resonators by a conductive bonding agent in the gap.

5. A dielectric resonator device according to claim 1 or claim 2, wherein the grounding electrodes are formed near the protrusion of the metal cover.

6. A dielectric resonator device according to claim 1 or claim 2, wherein the metal cover is arranged so as to expose the upper surfaces of the plurality of dielectric coaxial resonators.

7. A dielectric resonator device according to claim 1 or claim 2, wherein the metal cover is formed by a metal plate, and the protrusion of the metal cover is bent.

8. A communication apparatus comprising the dielectric resonator device according to one of claims 1 and 2, and connected thereto, a high-frequency circuit comprising one of a transmission circuit and a reception circuit.

9. A dielectric duplexer comprising:

a dielectric resonator device according to one of claims 1 and 2;

wherein said pair of dielectric coaxial resonators in the dielectric resonator device are comprised respectively in a transmission filter and a reception filter; and wherein said pair of dielectric coaxial resonators are separated from each other by said gap.

10. A communication apparatus comprising the dielectric duplexer according to claim 9; a transmission circuit being connected to said transmission filter and a reception circuit being connected to said reception filter.

* * * * *